US005127798A

United States Patent [19]

Campolmi

[11] Patent Number: 5,127,798

[45] Date of Patent: Jul. 7, 1992

[54] AIR MIXER

[76] Inventor: Paolo Campolmi, Via Marsala 3, 20061 Carugate, Milano, Italy

[21] Appl. No.: 656,485

[22] Filed: Feb. 19, 1991

[51] Int. Cl.[5] ..... B63H 1/26

[52] U.S. Cl. ..... 416/178; 416/187; 416/199; 415/203; 415/206

[58] Field of Search ..... 415/203, 206; 416/178, 416/187, 199, 175

[56] References Cited

U.S. PATENT DOCUMENTS

| | | | |
|---|---|---|---|
| 1,784,072 | 12/1930 | Oliver | 416/199 |
| 2,099,196 | 11/1937 | Chapman | 416/175 R |
| 2,104,233 | 1/1938 | Leinweber | 416/178 |
| 2,333,673 | 11/1943 | Poff | 416/199 |
| 2,753,162 | 7/1956 | Conley | 416/178 |
| 3,201,032 | 8/1965 | Gelbard | 416/175 R |
| 4,521,154 | 6/1985 | Corbett | 416/175 R |

FOREIGN PATENT DOCUMENTS

| | | | |
|---|---|---|---|
| 0985455 | 12/1982 | U.S.S.R. | 416/178 |

*Primary Examiner*—Thomas E. Denion

[57] ABSTRACT

An air mixer having a rotor with upper and lower horizontally oriented blades which draws air from above and below into the interior of the rotor so that thorough mixing occurs, after which the mixed air is expelled laterally by vertically oriented blades into the surrounding area and minimizes thermal stratification and other such conditions in the surrounding area.

1 Claim, 2 Drawing Sheets

PRIOR
ART

AIR MIXER

The present invention relates generally to improvements for an air mixer of the type generally in the category of the type described and illustrated in U.S. Pat. No. 1,784,072 issued on Dec. 9, 1930 to M. F. Oliver, in which air is drawn into a fan device from above and below and then discharged laterally thereof, and more particularly, to improvements embodied in the within inventive air mixer which results in a thorough pre-mixing of the air prior to discharge so that so-called thermal stratification of the air within the building structure in which the air mixer is used is effectively eliminated.

EXAMPLE OF THE PRIOR ART

As above noted, and as described and illustrated in the referenced Oliver patent, it is already known to use a fan device which attempts to draw air from above and below into the rotor thereof and discharge this air laterally to improve air circulation and benefits attendant thereto. A significant shortcoming however, is that the fan operation does not significantly obviate thermal stratification, by which is meant the temperature differences, or gradient, which exists between the air layer at the floor and the air layer at the ceiling, and the air layers therebetween.

Accordingly, it is an object of the present invention to provide an improved air mixer overcoming the foregoing and other shortcomings of the prior art. More particularly, it is an object to force the air from above and below to turbulently impinge within the interior of the rotor of the air mixer, to thereby contribute to a thorough mixing thereof, so that the discharged air is a homogeneous mixture which neutralizes thermal stratification.

The description of the invention which follows, together with the accompanying drawings should not be construed as limiting the invention to the example shown and described, because those skilled in the art to which this invention appertains will be able to devise other forms thereof within the ambit of the appended claims.

Figure 6:
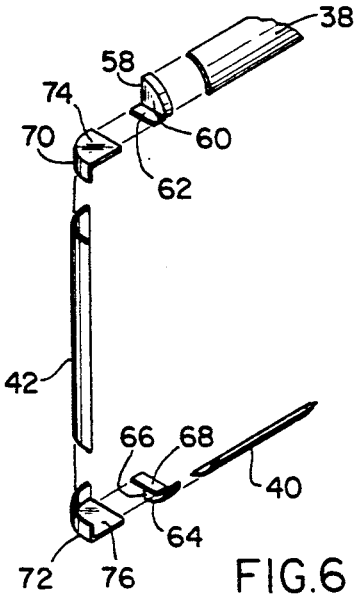
FIG. 6 is a detailed exploded view of selected components of the rotor.
Figure 7:
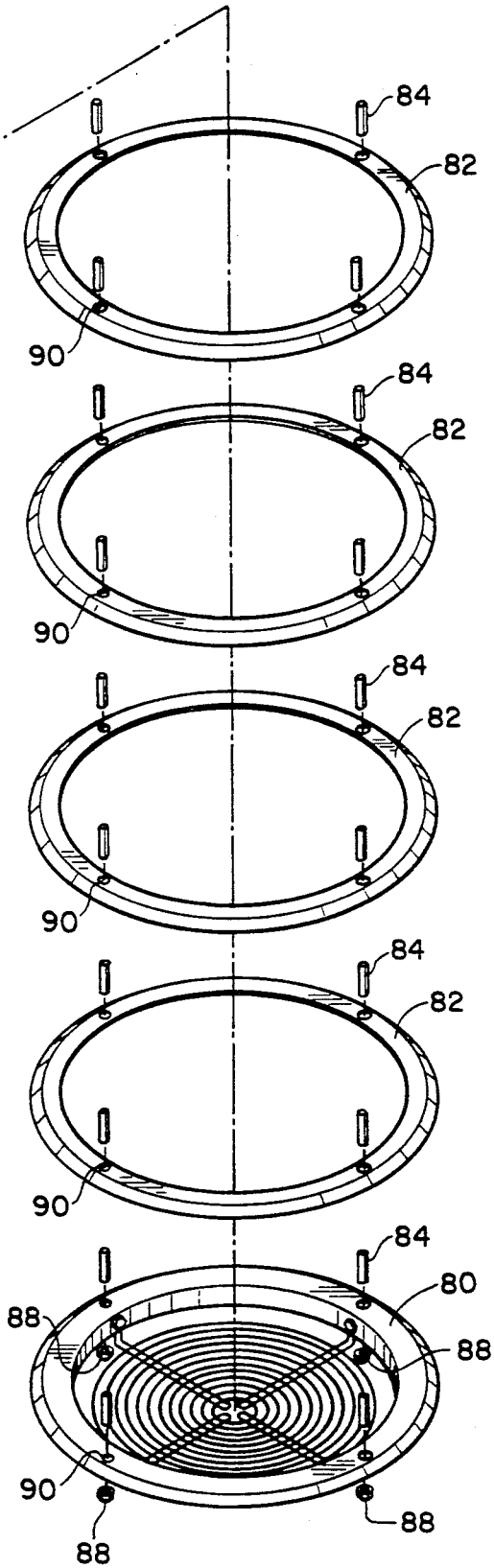
Figure 7:
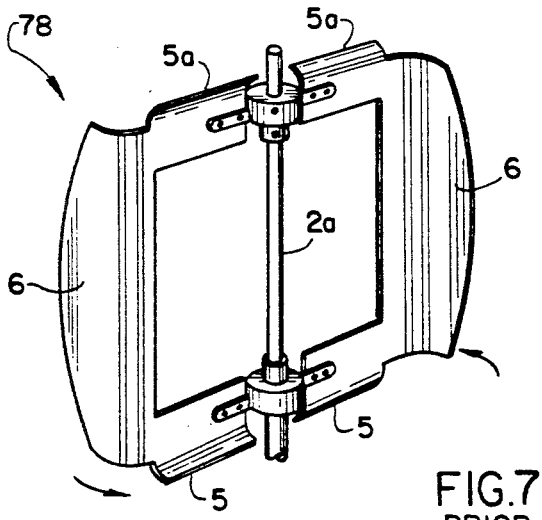

FIG. 7 is a prior art figure from U.S. Pat. No. 1,784,072 issued on Dec. 9, 1930 for comparison with FIG. 6.

It is already known that in structures having heights above 4 meters, the difference in temperature between floor and ceiling may be very large, reaching even 10 degrees C. This forces the heating equipment to maximum strength, to make up for this dispersion of heat. As will be better understood as the description proceeds, the within inventive air mixer, generally designated 10, is capable of equalizing the temperature and humidity of large volume buildings, both vertically and horizontally. It also cuts down by 20 to 40% the energy consumption necessary for their heating.

Figure 1:
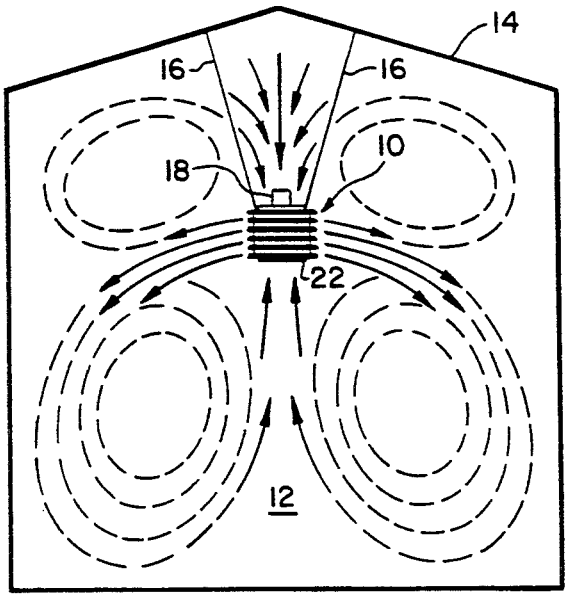
FIG. 1 is a schematic elevational view illustrating the flow pattern of the within inventive air mixer.

Referring now to the drawings, in FIG. 1 the within air mixer device 10 is shown in its application environment 12 where it is used to circulate and thoroughly mix all the air within a structure 14. Structure 14 can be any large building wherein thermal stratification takes place such as an arena for sports, or industrial or farm buildings, and the like. Device 10 is held by suspension means 16 and powered by an electric motor 18. As indicated in FIG. 1, by multiple reference air flow arrows, air streams are drawn into the mixer 10 from above and below, and then discharged radially in a slightly downward direction. While within unit 10, both the air from above and the air from below impinge with each other in the interior of the rotor of the mixer and consequently are thoroughly mixed before discharge.

Device 10 is comprised of an air impeller assembly or rotor 20 within a housing 22 and driven by electric motor 18. Motor 18 is bolted to an upper or grille/deflector assembly 24 by four bolts 26, washers 28 and nuts 30 along flange extensions 32. The upper grille or deflector assembly 24 forms the top portion of housing 22 and consists of an upper protective wire grille 34 bolted to air deflector ring 36. Grille 34 provides the inlet for air taken in from above unit 10.

Figure 4:
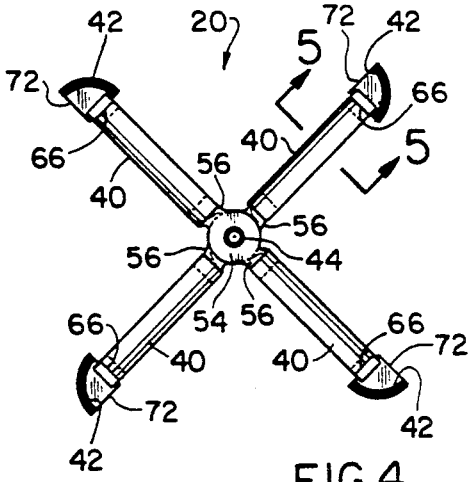
FIG. 4 is a sectional view as taken along line 4—4 of FIG. 3.
Figure 2:
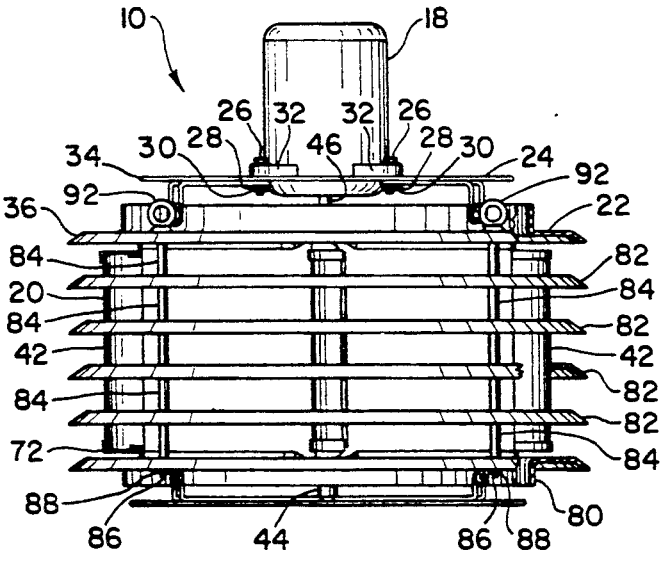
FIG. 2 is a detailed side elevational view of the air mixer partly broken away.
Figure 5:
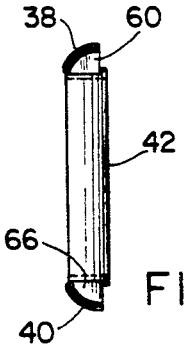
FIG. 5 is a sectional view as taken along line 5—5 of FIG. 4.
Figure 3:
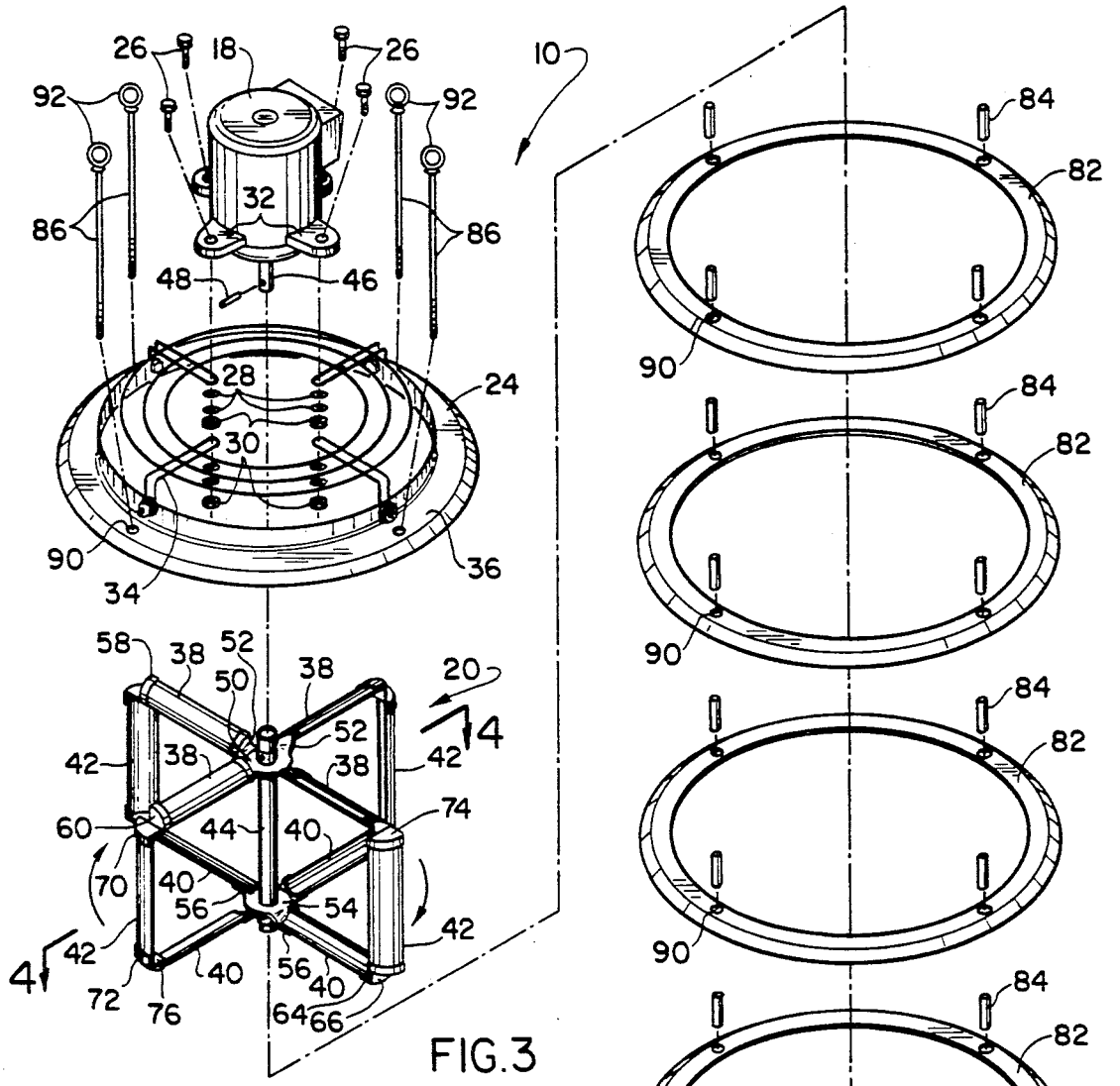
FIG. 3 is an exploded isometric view of the air mixer illustrating the component parts thereof in spaced relation.

Air impeller assembly or rotor 20, as best shown in FIG. 3, consists of an upper set of four horizontally oriented intake blades 38, a lower set of four horizontally oriented intake blades 40 and four discharge vertically oriented blades 42, operatively arranged in an intersecting relation. More particularly, the four sets of blades 38, 40 and 42 are oriented about a central tube member 44, again as best seen in FIG. 3. A hub member 44 fits snugly on motor shaft 46 and is secured thereon with a roll pin 48. A flange collar 50 secured to the upper end of hub member 44 has shaped extensions 52 that are spot welded to each of upper intake blades 38. Extensions 52 hold the shaped blades 38 so that air from above unit 10 is propelled interiorly when rotor 20 is rotated counter clockwise, as seen in FIGS. 3 and 4. Likewise a flange collar 54 secured to the lower end of hub member 44 has shaped extensions 56 spot welded to each of lower intake blades 40. Extensions 56 hold shaped blades 40 so that air from below unit 10 is propelled interiorly as impeller 20 rotates counter clockwise. Stated otherwise, the intake blades 38 and 40 are both curved as illustrated, and the curvature thereof is in the direction of rotation. The discharge or vertical blades 42 also are curved, and the curvature thereof is opposite to the direction of rotation. In practice, the curvature of the blades 38 and 40 bound air collecting compartments which during rotor rotation "collect" air therein and process this air in accordance with the flow pattern of FIG. 1. Most significantly, the air taken in from above and below the rotor 20 moving in opposite directions in the vertical blade compartments 42 impinge with each other, and this contributes to a more thorough mixing preparatory to discharge laterally by the blades 42, and obviates the previously noted thermal stratification.

Continuing with the detailed description of a preferred embodiment, spot welded at the outboard end of each upper intake blade 38, as best shown in FIG. 6, is a shaped bracket 58 which has a vertical wall 60 and weld tab 62. Similarly spot welded at the outboard end of each lower intake blade 40 is a similarly shaped bracket 64 which likewise has a vertical wall 66 and weld tab 68. Additionally, spot welded at the respective upper and lower ends of each discharge blade 42 are brackets 70 and 72, each of which has respective horizontal walls 74 and 76. In the assembly of the impeller or rotor 20, it is contemplated that the walls 74 and 76 be spot welded to respective weld tabs 62 and 68. This operative arrangement allows for the vertical discharge blades 42 to be essentially at right angles to the intake blades 38 and 40, with a curvature that is in facing relation to the curvature of the horizontal blades 38 and 40 so as to advantageously receive air directed from said blades 30, 40, and wherein said blade 42 curvature is also oriented backwards with relation to the direction of rotation and thus discharge mixed air from within the rotor 20 by centrifugal force.

At this point it is significant to note the function of the bracket vertical walls 60 and 66 at the ends of respective blades 38 and 40. This is best understood by comparison with the prior art fan of FIG. 7, to which reference is now made. Shown in FIG. 7 is one impeller blade of the prior art fan which in practice will be understood to be rotated counter clockwise on shaft 2*a*. The illustrated blade has an upper intake section 5*a* and a lower intake section 5, as well as a discharge blade section 6. When in use, air from above and below the impeller blade is "scooped" inwardly by intake blade sections 5*a* and 5. Under this rotary acceleration, this air also tends to move outwardly or slide radially and separately along blades 5*a* and 5, at the end of which it discharges without mixing with air from the opposite blade, i.e. the air from blade 5*a* does not mix with air from blade 5. Most of the air from above the unit thus is discharged at the same air level that it was drawn from, as occurs also with the air drawn from below.

In contrast to the operation just noted of the prior air fan, when air is "scooped" by intake blades 38 and 40 on impeller 20 the tendency for radially sliding movement thereof also takes place somewhat, but it is to be noted this air will impinge upon vertical walls 60 and 66 which effectively serve as closures for the ends of the blades 38 and 40 such that the air impinging against the walls 60 and 66 are turbulently forced towards the center section of impeller 20 where this air is well stirred and discharged as a homogeneous mixture by blades 42. Returning to FIG. 1, it can be seen that air from above is well mixed with air from below unit 10 by virtue of their impingement with each other, and after mixture are redistributed in a form which nullifies the effects of stratification.

For completeness' sake, the remaining parts of air mixer 10 not yet described but shown in the figures consist of the balance of housing assembly 22, and are the lower grille or deflector assembly 80, intermediate deflectors 82, spacer sleeves 84, through eyebolts 86 and self-locking nuts 88, all of which are assembled as shown in the figures, and in particular in FIG. 3. Each of the air deflectors 82 and the respective upper and lower deflectors in assemblies 24 and 80 will be understood to have suitable holes 90 to receive throughbolts 86 with spacer sleeves 84 placed therebetween in stacked relation. Eyes 92 on the upper ends of bolts 86 serve as connectors for suspension means 16 to support the assembled unit 10.

While the apparatus for practicing the within inventive air mixing method herein shown and disclosed in detail is fully capable of attaining the objects and providing the advantages illustrative of the presently preferred imbodiment of the invention and that no limitations are intended to the detail of construction or design herein shown other than as defined in the appended claims.

What is claimed is:

1. In a rotor of an air mixer of the type motor driven in a direction of rotation and consisting of plural upper and lower sets of horizontally oriented blades each curved in the direction of rotation so as to have the curvature thereof bound collecting compartments and mounted in spaced relation at opposite ends of plural vertically oriented blades so that said horizontally and vertically oriented blades have an operative relative position of an intersecting relation in said rotor, the improvement comprising said upper blades being oriented in a horizontal plane above the upper ends of said vertically oriented blades and said lower blades being oriented in a horizontal plane below the lower ends of said vertically oriented blades, said upper and lower blades terminating inwardly of said vertically oriented blades, a bracket at the outwardly directed end of each of said horizontal blades joining each to an adjacent end of one of said vertical blades and having a vertical wall strategically located to form a closure for the compartment of the cooperating horizontally oriented blade so as to block outwardly-directed horizontal or vertical movement of any air collected therein and adapted to direct same into the interior of said rotor, said directed air being in opposite directions from above and below said rotor caused by said upper and lower sets of horizontally oriented blades and impinging with each other in said interior of said rotor preparatory to being discharged laterally from said rotor by said vertically oriented blades, whereby said impingement of said horizontally oriented blade-directed air contributes to the mixing thereof preparatory to the lateral discharge thereof.

* * * * *